US008698857B2

(12) United States Patent
Kim et al.

(10) Patent No.: US 8,698,857 B2
(45) Date of Patent: Apr. 15, 2014

(54) DISPLAY DEVICE HAVING A MERGE SOURCE DRIVER AND A TIMING CONTROLLER

(75) Inventors: Young Ki Kim, Daejeon-si (KR); Hye Lan Kim, Asan-si (KR); Na Ra Hong, Daejeon-si (KR); Joon Ho Na, Daejeon-si (KR)

(73) Assignee: Silicon Works Co., Ltd., Daejeon-Si (KR)

( * ) Notice: Subject to any disclaimer, the term of this patent is extended or adjusted under 35 U.S.C. 154(b) by 272 days.

(21) Appl. No.: 13/335,224

(22) Filed: Dec. 22, 2011

(65) Prior Publication Data

US 2012/0162291 A1 Jun. 28, 2012

(30) Foreign Application Priority Data

Dec. 27, 2010 (KR) ..... 10-2010-0135720

(51) Int. Cl.
*G09G 5/10* (2006.01)

(52) U.S. Cl.
USPC ..... 345/691

(58) Field of Classification Search
USPC ..... 345/691
See application file for complete search history.

(56) References Cited

U.S. PATENT DOCUMENTS

2006/0232579 A1* 10/2006 Chen et al. ..... 345/211
2008/0055341 A1* 3/2008 Morita et al. ..... 345/690
2009/0213056 A1* 8/2009 Nam et al. ..... 345/90
2010/0085368 A1* 4/2010 Shin et al. ..... 345/534

* cited by examiner

*Primary Examiner* — Chanh Nguyen
*Assistant Examiner* — Long D Pham
(74) *Attorney, Agent, or Firm* — Kile Park Reed & Houtteman PLLC

(57) ABSTRACT

The present invention aims to provide a driving control circuit of a display device that is capable of preventing an unnatural black screen. To this end, the driving control circuit is configured to include a plurality of TMICs, each of which is merged with a timing controller and a source driver, and the time controller is configured to adjust end locations of the horizontal blank intervals of data enable signals to match the end locations outputted from TMICs to an end location of a horizontal blank interval of a data enable signal outputted from another TMIC, and, when a gate output enable signal is supplied, perform adjustment so as to indicate a rising edge of the gate output enable signal before the data latch enable signal having the highest frequency is supplied.

10 Claims, 8 Drawing Sheets

| nsb_goe[1] | nsb_goe[0] | TGOE (CLK) |
|---|---|---|
| 0 | 0 | -40 |
| 0 | 1 | 0(default) |
| 1 | 0 | +40 |
| 1 | 1 | +80 |

FIG.10

| nsb_hbp[1] | nsb_hbp[0] | THBP (CLK) |
|---|---|---|
| 0 | 0 | N - 25 |
| 0 | 1 | N (default) |
| 1 | 0 | N + 25 |
| 1 | 1 | N + 50 |

DISPLAY DEVICE HAVING A MERGE SOURCE DRIVER AND A TIMING CONTROLLER

BACKGROUND OF THE INVENTION

1. Field of the Invention

The present invention relates to a technology for driving a display device, and more particularly, to a driving control circuit of a display device that is capable of preventing a black screen from being unnaturally displayed in a non-signal state when using a timing controller which is merged with a plurality of source driver ICs.

2. Description of the Related Art

In recent years, flat-panel display devices, such as a liquid crystal display (LCD), a plasma display panel (PDP), an organic light emitting diode (OLED) panel and the like, have been widely used. Among such devices, liquid crystal displays are continually proliferating.

As a typical example of a flat panel display device, the liquid crystal display is configured to include a display panel (or a liquid crystal panel), in which a plurality of gate lines and a plurality of data lines are arranged in directions perpendicular to each other to create a pixel area having a matrix form; a driving circuit portion, for supplying driving signals and data signals to the display panel; and a backlight, for providing light to the display panel.

FIG. 1 shows a block diagram of a display device that includes a display panel and a driving circuit portion according to the related art. As shown in FIG. 1, the display device is configured to include a display panel 110, a timing controller 120, a plurality of source driver ICs 130A to 130C, and a gate driver IC 140.

Referring to FIG. 1, the display panel 110 includes a plurality of pixels arranged at intersections of the plurality of gate lines and the plurality of data lines in a matrix form. A transistor formed in each of the pixels transfers data voltage inputted from the data line to a pixel driving element in response to a scan signal supplied from the corresponding gate line.

The timing controller 120 is installed on a main board, which is provided separately from the display panel 110, to generate a gate control signal for controlling a gate driver IC 140 and data control signals for controlling source driver ICs 130A to 130C by using vertical and horizontal sync signals and a clock signal supplied from a system. In addition, the timing controller 120 rearranges digital video RGB data (hereinafter, referred to as 'data') inputted from the system to supply the data to the source driver ICs 130A to 130C.

The source driver ICs 130A to 130C convert the data into data voltage corresponding to a gray scale value to supply the converted data voltage to data lines of the display panel 110 in response to the data control signal supplied from the timing controller 120.

The gate driver IC 140 sequentially supplies a scan pulse (gate pulse) to the gate line in response to the gate control signal supplied from the timing controller 120 such that horizontal lines of the display panel 110, to which the data are supplied, are selectively driven.

In the state in which a normal signal is not inputted, the timing controller 120 provides data (mainly, black data) generated from an oscillator in the timing controller 120 to the source driver ICs 130A to 130C. The state in which a normal signal is not inputted includes a state in which power is supplied and a signal is not inputted (all intervals of the normal signal inputted after power is supplied) and a state in which power is applied and a non-normal signal, which deviates from a normal operational range, enters.

However, even if the normal signal is not inputted, since a single timing controller 120 provides data to the plurality of source driver ICs 130A to 130C to drive them, a problem in which data outputs of the plurality of source driver ICs 130A to 130C need to be synchronized with each other does not occur.

In recent years, in order to meet the needs of larger and thinner display devices, a product (TMIC) (hereinafter, referred to as "TMIC"), each timing controller is merged with a plurality of source driver ICs, has been developed.

Thus, if each timing controller is merged with a plurality of source driver ICs, the timing controller includes an oscillator on the inside to perform a timing control function and a source driving function. Accordingly, when a plurality of TMICs is used for driving the display panel, deviation between the frequencies generated from the oscillator included in each TMIC can occur, and thus in the state in which a normal signal is not inputted, if each TMIC outputs image data by using a horizontal synchronization signal, a vertical synchronization signal and a data enable signal generated by a clock signal of the internal oscillator, there is a problem in that the image data are not synchronized with each other.

In addition, there is a problem in that an enable interval of the data enable signal generated from the oscillator, which generates the clock signal having the slowest frequency, is longer than one horizontal interval of the horizontal synchronization signal generated from the oscillator, which generates the clock signal having the fastest frequency.

Further, the input of the gate driver IC uses an output of a master TMIC, and thus there is a problem in that a latch enable signal of the last datum of each TMIC precedes a gate output enable signal.

Accordingly, in the display device of the related art, there is a defect in that an unnatural black screen is displayed on a display panel when a vertical synchronization signal or a horizontal synchronization signal or a data enable signal, or a data clock signal is not inputted, or when a signal that deviates from a normal operational range is inputted, in the state in which power is supplied.

SUMMARY OF THE INVENTION

Accordingly, the present invention has been made in an effort to solve the problems occurring in the related art, and an object of the present invention is to provide a driving control circuit of a display device capable of preventing an unnatural black screen from being displayed on a display panel when a signal is not inputted, or even when a signal that deviates from a normal operational range is inputted, in the display device including a plurality of TMICs into each of which a timing controller is merged.

In order to achieve the above object, according to one aspect of the present invention, there is provided a driving control circuit including a display panel; one or more slave TMICs and one master TMIC, each of which is merged with a timing controller and a source driver; and a gate driver IC, which receives a gate output enable signal from the master TMIC to supply the corresponding scan pulse to a gate line of the display panel, wherein the time controller is configured to adjust end locations (transition time points from 'low' level to 'high' level) of the horizontal blank intervals of data enable signals to match the end locations outputted from TMICs to an end location of a horizontal blank interval of a data enable signal outputted from another TMIC, and, when a gate output enable signal is supplied, perform adjustment so as to indicate a rising edge of the gate output enable signal before the data latch enable signal having the highest frequency is supplied.

BRIEF DESCRIPTION OF THE DRAWINGS

The above objects, and other features and advantages of the present invention will become more apparent after a reading of the following detailed description taken in conjunction with the drawings, in which:

FIG. 10 is a table indicating a method in which end locations of a horizontal blank interval of a data enable signal generated from a TMIC location are matched to each other, as an example.

DETAILED DESCRIPTION OF PREFERRED EMBODIMENTS

Figure 1:
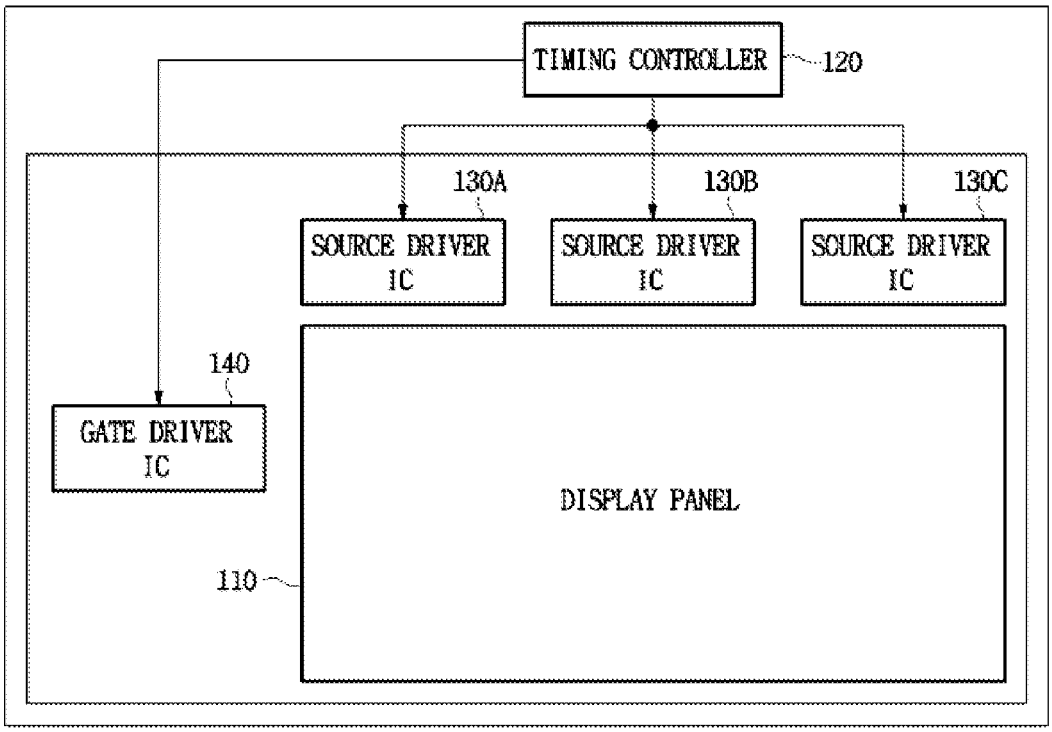
FIG. 1 is a block diagram of a display device according to the related art.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
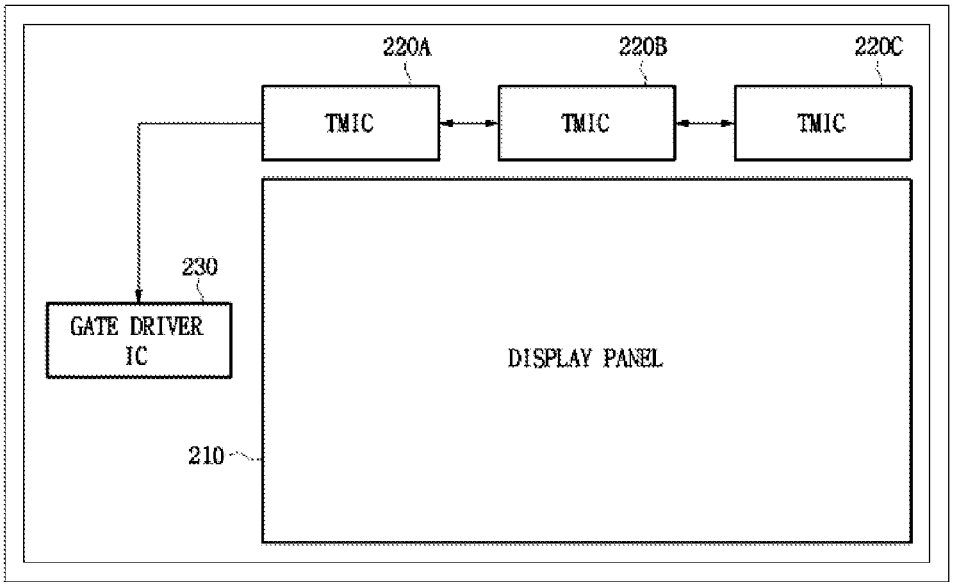
FIG. 2 is a block diagram of a driving control circuit of a display device according to an embodiment of the present invention.

FIG. 2 shows a block diagram of a driving control circuit of a display device in accordance with the present invention. As shown in FIG. 2, the driving control circuit includes a display panel 210, a plurality of TMICs 220A to 220C, and a gate driver IC 230.

Referring to FIG. 2, the display panel 210 includes a plurality of pixels arranged at intersections of a plurality of gate lines and a plurality of data lines in a matrix form. A transistor formed in each of the pixels transfers data voltage inputted from the data line to a pixel driving element in response to a scan signal supplied from the corresponding gate line.

Each of the TMICs 220A to 220C includes a structure in which one timing controller is merged with one source driver IC. In this case, the respective timing controllers generate image data and various control signals by using an oscillation signal generated from a separate built-in oscillator. Here, an example in which the first to third TMICs 220A to 220C use 44 MHz, 40 MHz and 36 MHz oscillators, respectively, will be described.

In such a case, any one of the TMICs 220A to 220C can operate as a master IC, and the remaining TMICs can operate as slave ICs. Herein, an example in which the first TMIC 220A operates as the master IC and the remaining second and third TMICs 220B and 220C operate as the slave ICs will be described below.

As described above, since the TMICs 220A to 220C each use oscillation signals having different frequencies, cycles of a horizontal synchronization signal HSYNC and a data enable signal DE each appear differently due to the different frequencies of the oscillation signals. Accordingly, there is a problem in that each source driver IC of the TMICs 220A to 220C output data having slightly different timing for each horizontal line.

Figure 3:
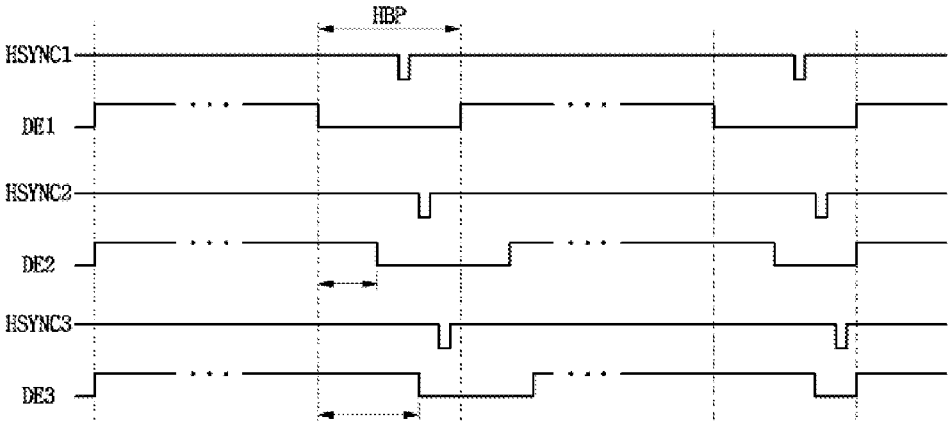
FIG. 3 is a waveform view of a horizontal synchronization signal and a data enable signal outputted from the TMIC shown in FIG. 2.

In consideration of this problem, the TMICs 220B and 220C receive the data enable signal DE from the TMIC 220A and then match the end locations of the horizontal blank intervals of data enable signals DE2 and DE3 generated from the TMICs 220B and 220C to the end location of a horizontal blank interval of a data enable signal DE generated from the source driver IC of the TMIC 220A. FIG. 3 is a waveform indicating this example.

In FIG. 3, a horizontal synchronization signal HSYNC1 and a data enable signal DE1 are generated from the TMIC 220A, a horizontal synchronization signal HSYNC2 and a data enable signal DE2 are generated from the TMIC 220B, and a horizontal synchronization signal HSYNC3 and a data enable signal DE3 are generated from the TMIC 220C. Here, 'HBP' is a horizontal blank interval, and by adjusting the interval, a problem in which one cycle of the enable interval of the data enable signal DE3 generated from the oscillator that generates the clock signal having the slowest frequency is longer than one cycle of the enable interval of the data enable signal DE1 generated from the oscillator that generates the clock signal having the fastest frequency can be solved.

As shown in FIG. 3, cycles of the data enable signals DE1 to DE3 are equivalent to cycles of the horizontal synchronization signals HSYNC1 to HSYNC 3, and the cycle of the horizontal synchronization signal HSYNC2 is longer than the cycle of the horizontal synchronization signal HSYNC1 and the cycle of the horizontal synchronization signal HSYNC3 is longer than the cycle of the horizontal synchronization signal HSYNC2, due to the use of the oscillation signal in TMICs 220A to 220C as described above. Accordingly, after first cycles (first vertical lines) of the data enable signals DE2 and DE3, end locations of the horizontal blank interval of the data enable signals DE2 and DE3 appear slightly late compared to the end location of the horizontal blank interval of the data enable signal DE1.

For reference, 'high' intervals of the data enable signals DE1 to DE3 are preparation intervals for loading data into the data line of the display panel 210 by the source driver IC of the TMICs 220A to 220C, and the 'low' intervals of the horizontal blank intervals are intervals for loading data into the data line.

The TMICs 220B and 220C detect transition time points (end locations of horizontal blank intervals) from a 'low' level to a 'high' level of data enable signals DE2 and DE3 by using the oscillation signal of the oscillators for each clock, and find a transition time point at which the data enable signal DE1 is transitive from a 'low' level to a 'high' level to match the end locations of the horizontal intervals of the date enable signals DE1 to DE3. Here, the data enable signal DE1 is a signal that is received from the master TMIC 220A.

FIG. 3 shows results in which the end locations of the horizontal intervals of the date enable signals DE1 to DE3 are matched using the procedures described above.

The gate driver IC 230 sequentially supplies a scan pulse (gate pulse) to the gate line in response to the gate control signal supplied from any one timing controller of the TMICs 220A to 220C, for example, the timing controller (hereinafter, referring to as a master timing controller) of the TMIC 220A, such that horizontal lines of the display panel 210 to which the data are supplied may be selectively driven.

However, since a gate output enable signal GOE supplied to the gate driver IC 230 by the master timing controller is generated by using an oscillation signal having frequencies different to those used in other timing controllers, as described above, there may be a problem in which last latch enable signals LOAD of each of the TMICs 220A to 220C precede the transition time point at which the gate output enable signal GOE is transitive from the 'low' level to the 'high' level.

In order to solve this problem, in this embodiment, when the gate output enable signal GOE is supplied to the gate drive IC 230, the gate output enable signal GOE is adjusted and outputted to indicate the rising edge before the data latch enable signal LOAD, having the highest frequency for each corresponding cycle, is supplied, as will be described with reference to FIGS. 4 to 7.

For reference, a 'low' interval of the gate output enable signal GOE is an interval during which the gate line of the display panel 21 is driven and a data voltage supplied through the data line is transmitted, and a 'high' interval is an interval in which the gate line is not driven.

Figure 4:
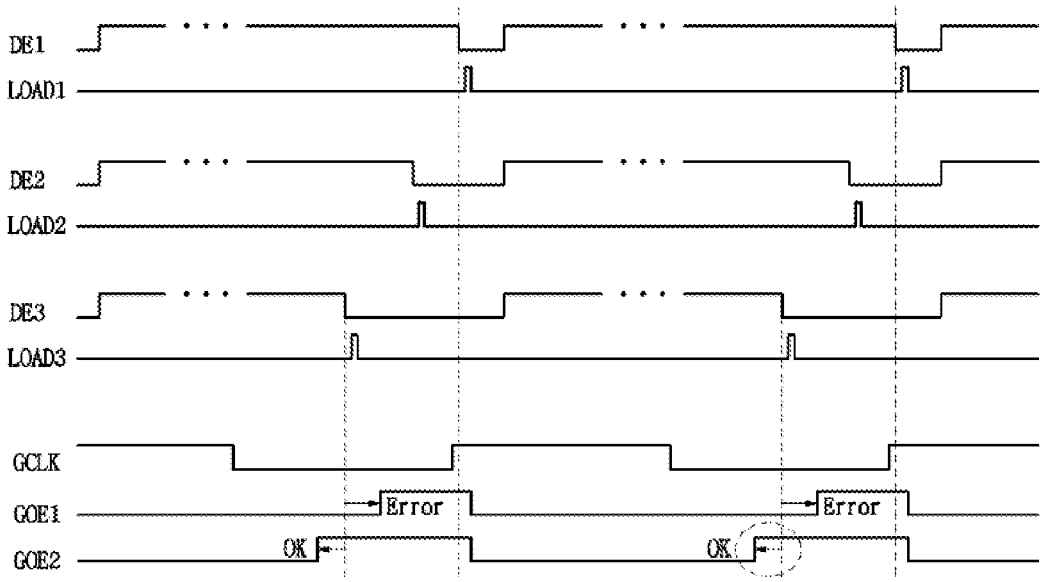
FIG. 4 is a waveform view of a data enable signal, a data latch enable signal, a shift clock signal and a gate output enable signal outputted from the TMIC shown in FIG. 2.

In FIG. 4, the data enable signal DE1 and the data latch enable signal LOAD1 are generated in the TMIC 220A, and the TMIC 220A uses a 36 MHz oscillator as an example. The data enable signal DE2 and the data latch enable signal LOAD2 are generated in the TMIC 220B, and the TMIC 220B uses a 40 MHz oscillator as an example. The data enable signal DE3 and the data latch enable signal LOAD3 are generated in the TMIC 220C, and the TMIC 220C uses a 44 MHz oscillator as an example.

In such a case, it can be seen that the data enable signals DE3 to DE1 are transitive from the 'high' level to the 'low' level in descending order of frequency and thus synchronized according to the transitions, and the data latch enable signals LOAD3 to LOAD1 are generated in descending order of frequency.

Further, it can be seen that since the gate output enable signal GOE1 supplied to the gate driver IC 230 by the master timing controller is generated using an oscillation signal having frequencies different to those used in another timing controller, as described above, the latch enable signals LOAD3 having the highest frequency may be already generated before the gate output enable signal GOE is transitive from the 'low' level to the 'high' level. In this case, there is a problem in that, before the data of the previous horizontal line are fully loaded, duplicate data of the current horizontal line are also loaded, and thus data of the previous horizontal line are lost by the duplicated portion.

In order to prevent this problem, the gate output enable signal is corrected according to the embodiment, and the corrected gate output enable signal is represented as 'GOE2'. That is, the master timing controller is adjusted such that the rising edge of the gate output enable signal GOE2 slightly precedes the data latch enable signal LOAD3 having the highest frequency to thus output the adjusted signal to the gate driver IC 23. Even though the output enable signals GOE1 and GOE2 are the same signal GOE, the signals are expressed with different numbers to enable the adjusted states to be distinguished.

Of course, when the gate output enable signal GOE is corrected as described above, the 'low' interval is lost by the extended 'high' interval of the gate output enable signal GOE, but the degradation in quality of the black screen due to the lost interval is negligible.

Figure 5:
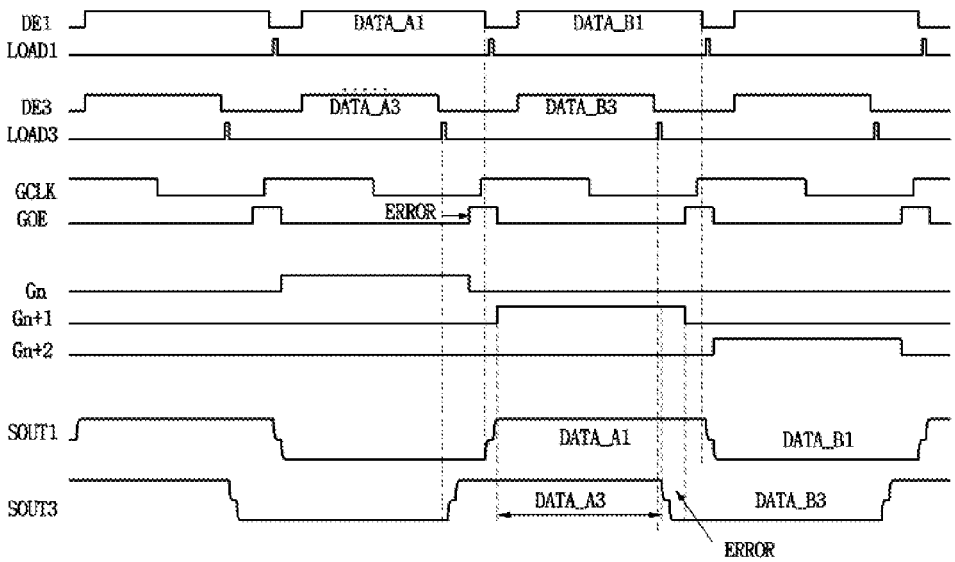
FIG. 5 is a waveform view indicating that an error interval is generated by a mismatch between a data latch enable signal and a gate output enable signal.

FIG. 5 is a waveform view showing that an error interval is generated because the gate output enable signal GOE is already transitive to a 'low' level before the last data latch enable signal LOAD of each of the TMICs 220A to 220C is supplied, as described above.

Referring to FIG. 5, it can be seen that the data latch enable signal LOAD3 is already generated in the TMIC 220C including the oscillator that generates clock signals having the highest frequencies before the gate output enable signal GOE is transitive from the 'low' level to the 'high' level. Accordingly, the output of the source driver of TMIC 220A can be continually maintained at the 'high' level in the driving interval of the gate line Gn+1, but the output SOUT3 of the source driver of the TMIC 220C generates an error interval ERROR maintaining the 'low' level at the end portion.

Figures 6, 7:
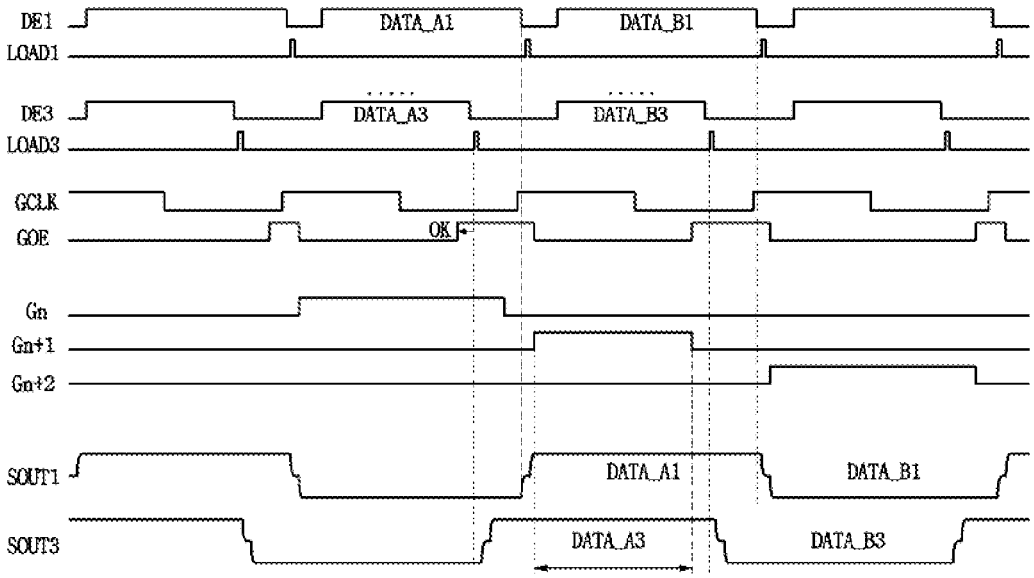
FIG. 6 is a waveform view indicating that a mismatch between a data latch enable signal and a gate output enable signal is solved in accordance with the present invention.
FIG. 7 is a table showing an example in which the generation time point of a gate output enable signal is adjusted during a non-signal operation.

FIG. 6 is a waveform view indicating that an error interval is not generated by adjusting such that the gate output enable signal GOE is transitive from a 'low' level to a 'high' level, before the last data latch enable signal LOAD of each of the TMICs 220A to 220C is supplied, as described above.

Referring to FIG. 6, as described above, the rising edge of the gate output enable signal GOE is adjusted to be extended in the previous time direction, and the end portion of a driving interval of a gate line Gn+1 is reduced by the extended width of the gate output enable signal GOE. Accordingly, the output SOUT3 of a source driver of the TMIC 220C, as well as the output SOUT1 of a source driver of the TMIC 220A, are maintained at the 'high' level, and thus the error interval ERROR is not generated, as described above.

The system for displaying the display device using a plurality of TMICs is designed such that the time point at which the gate output enable signal GOE is generated during non-signal operation is earlier than during normal operation. Nevertheless, if the frequency deviation of the oscillator between TMICs used in the display device is greater than expected, it should be adjusted such that the generation time point of the gate output enable signal GOE can be generated such that it is earlier than the original generation time point. In contrast, if the frequency deviation of the oscillator between TMICs used in the display device is less than expected, and thus, even the gate output enable signal GOE is generated to be later than original generation time point and a question is not raised in display, it is adjusted such that the time point at which the gate output enable signal GOE is generated is later than the original generation time point to thus provide pixel-charging time for the source driver.

There may be several methods of adjusting the generation time point of the gate output enable signal GOE as described above.

As a first example, the TMIC 220A, operating as a master, can adjust the generation time point of the gate output enable signal GOE by varying a register value, which is separately provided using an inter-integrated circuit I2C or a serial peripheral interface SPI.

As a second example, the generation time point of the gate output enable signal GOE can be adjusted by varying an input value of a separate input option pin assigned in an integrated circuit.

The two embodiments will be described in detail with reference to FIG. 7. The name of the separate register or option pin for adjusting the generation time point of the gate output enable signal GOE is indicated as nsb_goe. In this case, if 2 bits are assigned to nsb_goe, the generation time point of the gate output enable signal GOE can be adjusted.

That is, when nsb_goe is '01', the generation time point of the gate output enable signal GOE is set to "0", as a default value. When nsb_goe is '00', the generation time point of the gate output enable signal GOE is set to "−40×oscillator's clock frequency CLK". When nsb_goe is '10', the generation time point of the gate output enable signal GOE is set to "+40×oscillator's clock frequency CLK". When nsb_goe is '11', the generation time point of the gate output enable signal GOE is set to "+80×oscillator's clock frequency CLK". The 2 bits are assigned to the register or option pin as the number of bits, but the number of bits can be set to 3 or more bits, if necessary. In addition, "−40", "+40" and "+80" are exemplary numbers, and the numbers may be set to be suitable for the system depending on the design.

Figure 8:
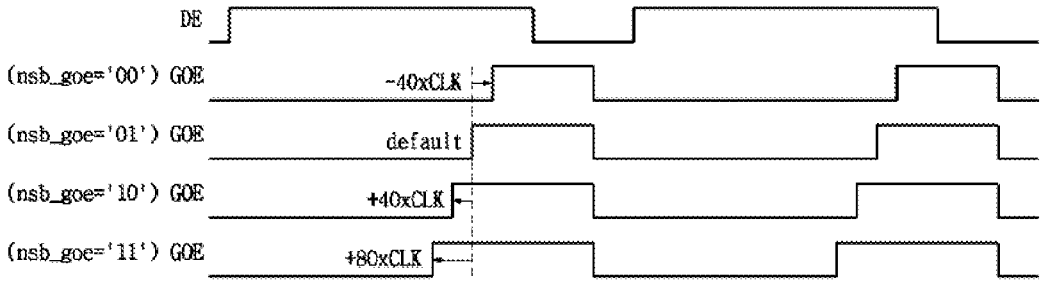
FIG. 8 is a waveform view indicating an example in which the generation time point of a gate output enable signal is adjusted during a non-signal operation.

FIG. 8 is a waveform view indicating an example in which the generation time point of the gate output enable signal is adjusted according to the adjustment operation as shown in FIG. 7.

Figure 9:
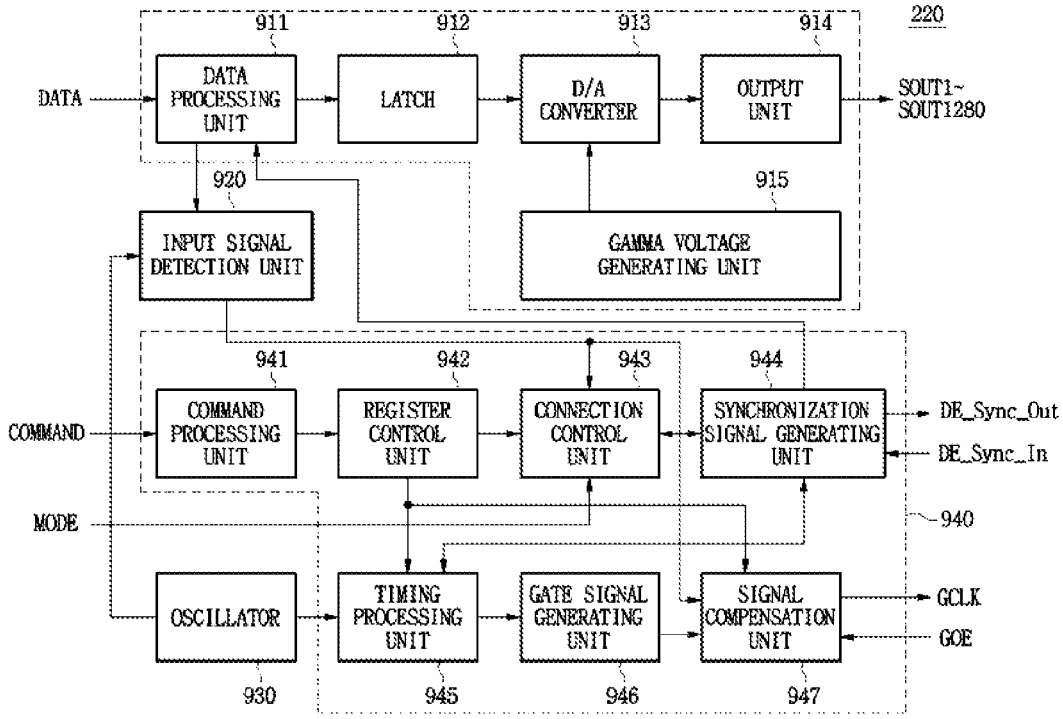
FIG. 9 is a detail block diagram of TMIC shown in FIG. 2.

Meanwhile, FIG. 9 is a detail block diagram of the TMICs 220A to 220C according to the embodiment of the present invention. As shown in FIG. 9, each TMIC includes a source driver 910, an input signal detection unit 920, an oscillator 930 and a timing controller 940.

The source driver 910 includes a data processing unit (data interface control & data generator) 911, a latch 912, a digital to analog (D/A) converter 913, an output unit 914 and a gamma voltage generating unit 915.

The timing controller 940 includes a command processing unit 941, a register control unit 942, a connection control unit 943, a synchronization signal generating unit 944, a timing processing unit 945, a gate signal generating unit 946 and a signal compensation unit 947.

Referring to FIG. 9, the data processing unit 911 receives data DATA from the outside and transmits the received data to the latch 912 in the normal state. However, when the data DATA are not received, the data processing unit 911 receives a source signal from the synchronization signal generating unit 944 in the timing controller 940 and transmits generated data (black data) to the latch 912.

The latch 912 temporarily stores data supplied from the data processing unit 911 and outputs the data to the D/A converter 913.

The D/A converter 913 selects and outputs data voltage (gray voltage) corresponding to data inputted from the latch 912, among gray scale voltage of a predetermined step generated from the gamma generating unit 915.

The output unit 914 buffer-amplifies data voltage of each channel which is applied from the D/A converter 913 and outputs the amplified data voltage to the data line of the display panel.

The input signal detection unit 920 detects whether a normal signal is inputted or the normal signal is not inputted, that is, a non-signal state, by using a clock signal generated from the oscillator 930, and then provides the detected signal to the connection control unit 943 and the signal compensation unit 947.

The command processing unit 941 interfaces an inputted command signal COMMAND and provides the same to the register control unit 942.

The register control unit 942 controls the connection control unit 943, the timing processing unit 945 and the signal compensation unit 947 in response to the command signal COMMAND from the command processing unit 941. The command signal COMMAND may include deviation information for controlling the timing of the signal. The deviation information is information related to frequency deviation of the oscillators in a plurality of TMICs 220A to 220C. In such a case, the register control unit 942 writes the deviation information into the internal register and controls the connection control unit 943, the timing processing unit 945 and the signal compensation unit 947 based on the deviation information.

The connection control unit 943 determines whether any TMIC 220 of the TMICs 220A to 220C is operated as a master or a slave by using mode determination information stored in the internal register and provides the mode determination information to the synchronization generating unit 944. There may be several methods in which the mode determination information is stored (set) in the internal register of the connection control unit 943. For example, the mode determination information may be stored in the register of the connection control unit 943 using a mode signal MODE and the command signal COMMAND. As another example, if the detection signal of the non-signal state is first received in the connection control unit 943 in the corresponding TMIC 220 of the TMICs 220A to 220C through the input signal detection unit 920, the register can be set as the master mode.

The synchronization generating unit 944 receives notification of the master mode from the connection control unit 943, generates source control signals, such as a vertical synchronization signal VSYNC, a horizontal synchronization signal HSYNC, a data enable signal DE, and the like according to the control of the timing processing unit 945, and provides the signals to the data processing unit 911. The synchronization generating unit 944 provides the generated data enable signal DE as described above to the adjacent TMIC through the synchronization signal output terminal DE_Sync_Out. The synchronization generating unit 944 receives the data enable signal DE from the TMIC operating as the master of the TMICs 220A to 220C and provides the received data enable signal DE to the timing processing unit 945.

Accordingly, the timing processing unit 945 generates the source control signal and the gate control signal by using the data enable signal DE to provide the generated signals to the synchronization generating unit 944 and the gate signal generating unit 946. The gate control signal includes a gate clock signal GCLK and a gate output enable signal GOE.

The timing processing unit 945 generates timing information by using the clock signal of the oscillator 930 and controls the driving of the synchronization generating unit 934 and the gate signal generating unit 946 by using the generated timing information.

The gate signal generating unit 946 generates a gate control signal according to the control of the timing processing unit 945, and provides the generated signal to the signal compensation unit 947.

The signal compensation unit 947 compensates for the deviation of the gate control signal according to the frequency deviation of the TMIC 220 by using the deviation information stored in the internal register of the register control unit 942.

As described above, in the state in which the normal signal is not inputted, each of TMICs 220A to 220C generates the horizontal synchronization signal HSYNC, the vertical synchronization signal VSYNC, and the data enable signal DE by using the internal oscillator 930. When each TMIC outputs the data using these signals, there is a problem in which the outputted data are not synchronized with each other. The process for solving this problem will be described in more detail with reference to FIG. 3.

Here, as described in the example, the first TMIC 220A uses a 44 MHz oscillator as a master, the second TMIC 220B uses a 40 MHz oscillator as a slave, and the third TMIC 220C uses a 36 MHz oscillator as a slave.

When the any TMIC 220 shown in FIG. 9 is the TMIC 220B, the synchronization generating unit 944 receives the data enable signal DE1, inputted from the TMIC 220A, through the synchronization input terminal DE_Sync_In, and transmits the data enable signal DE2, generated by its own TMIC 220B along with the received data enable signal DE1, to the timing processing unit 945.

The timing processing unit 945 compares end locations of the horizontal blank interval HBP of a first cycle, which is a pre-cycle, for the data enable signals DE1 and DE2. As a result, it can be seen that the end location of the data enable signal DE2 is later than the end location of the horizontal interval of the data enable signal DE1, as shown in FIG. 3. Accordingly, the timing processing unit 945 performs control such that the synchronization generating unit 944 is allowed to match the end location of the horizontal interval of the data enable signal DE2 and the end location of the horizontal interval of the data enable signal DE1 from the second cycle. Also, from that point in time, the timing processing unit 945 performs control such that the synchronization generating unit 944 is allowed to match the end locations to each other by performing the same operation as described above for each cycle of the data enable signals DE1 and DE2.

The synchronization generating unit 944 generates the data enable signal DE2 corrected to match the end location of the horizontal blank interval and the end location of the blank interval of the data enable signal DE1, and then provides the corrected signal to the data processing unit 911. Accordingly, the data processing unit 911 outputs data by using the data enable signal DE1 provided as described above, and thus the first generation time point for each horizontal line can be matched to data outputted from the TMIC 220A as a master.

In addition, the third TMIC 220C generates the data enable signal DE3 in which the end location of the horizontal blank interval is matched to the end location of the data enable signal DE1, and outputs the matched data through the same process as described above. Thus, the first generation time point for each horizontal line can be matched to data outputted from the TMIC 220A.

Meanwhile, there may be several methods in which the end locations of the horizontal blank interval of the data enable signal DE generated from the TMICs 220A to 220C are matched to each other, as described above.

As a first example, the timing processing unit 945 can adjust the horizontal blank interval HBP such that it is longer or shorter than the original horizontal blank interval by varying register values separately provided by using an inter-integrated circuit I2C or a serial peripheral interface SPI.

As a second example, the horizontal blank interval HBP can be adjusted such that it is longer or shorter than the original interval by varying an output value of a separate option pin assigned in an integrated circuit.

The two embodiments will be described in greater detail with reference to FIG. 10. The name of the separate register or option pin for adjusting the horizontal blank interval HBP during a non-signal operation is indicated as nsb_hbp. In this case, if 2 bits are assigned to nsb_hbp, the horizontal blank interval HBP can be adjusted according to the bit value. That is, when nsb_hbp is '01', the horizontal blank interval HBP is set to "N×oscillator's clock frequency" as a default setting value. When nsb_hbp is '00', the horizontal blank interval HBP is set to "(N−25)×oscillator's clock frequency". When nsb_hbp is '10', the horizontal blank interval HBP is set to "(N+25)×oscillator's clock frequency". When nsb_hbp is '11', the horizontal blank interval HBP is set to "(N+50)× oscillator's clock frequency".

2 bits are assigned to the register or option pin as the number of bits, but the number of bits can be set to 3 or more bits, if necessary. In addition, "N" is not a fixed value and may be set to be suitable for the system, and "−25", "+25" and "+50" are exemplary numbers, and may be set to be suitable for the system depending on the design.

As is apparent from the above description, the present invention provides a driving control circuit of a display device including a plurality of TMICs, each of which is merged with a timing controller and a source driver, wherein end locations of horizontal intervals from the slave TMICs are matched to an end location of a horizontal interval of the master TMIC, and the rising edge of the gate output enable signal slightly precedes the data latch enable signal having the highest frequency. Thus, the present invention is capable of preventing an unnatural black screen from being displayed on a display panel when a signal is not inputted, or even when a signal that deviates from a normal operational range is inputted.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A driving control circuit of a display device comprising:

a plurality of integrated circuit (TMIC) having a merge timing controller and a source driver, wherein the plurality of TMIC comprises one master TMIC and one or more slave TMICs, wherein the timing controller is configured to match end locations of horizontal blank intervals of data enable signals from the slave TMICs to an end location of a horizontal blank interval of a data enable signal outputted from the master TMIC, and, when a gate output enable signal is supplied, to adjust so as to indicate a rising edge of the gate output enable signal before a data latch enable signal having a highest frequency is supplied.

2. The driving control circuit according to claim 1, wherein the timing controller is configured to include a separate oscillator, and to output image data by using a horizontal synchronization signal, a vertical synchronization signal and a data enable signal generated by a clock signal.

3. The driving control circuit according to claim 1, wherein when matching by adjusting the end locations of the horizontal blank intervals of the data enable signals, the TMIC is configured to be matched by extending the end location of the horizontal blank interval of the corresponding data enable signal in a previous time direction.

4. The driving control circuit according to claim 1, wherein the plurality of TMIC are configured to comprise:

the timing controller including a synchronization generating unit, which transmits a data enable signal generated in an inside and the data enable signal inputted from the master TMIC to a timing processing unit and matches the end locations of the horizontal blank intervals of the date enable signals to the end location of the horizontal blank interval of the corresponding data enable signal from the master TMIC based on control of the timing processing unit, the timing processing unit, which compares the horizontal blank intervals of two data enable signals received from the synchronization generating unit and controls a data enable signal generating operation of the synchronization signal generating unit based on a comparison result, and a signal compensation unit for compensating for a deviation of the gate control signal according to a frequency deviation between the master and slave TMICs by using deviation information stored in a register control unit; and the source driver including a data processing unit which matches a first data generation time point of each horizontal line to a data generation time point from the master TMIC based on the data enable signal received from the synchronization generating unit.

5. The driving control circuit according to claim 4, wherein the TMICs are configured to further comprise:

an input signal detection unit, which detects whether a normal signal is inputted or the normal signal is not inputted to the data processing unit, which is a non-signal state, and provides the detected signal to the signal compensation unit.

6. The driving control circuit according to claim 4, wherein the master and slave TMICs are configured to further comprise:

a connection control unit which determines whether any TMIC of the plurality of TMICs is operated as a master or a slave by using mode determination information stored in the internal register and provides the mode determination information to the synchronization generating unit.

7. The driving control circuit according to claim 1, wherein the plurality of TMIC are configured to vary a register value, which is separately provided by using an inter-integrated circuit I2C or a serial peripheral interface (SPI) when matching the end locations of the horizontal intervals of the data enable signals.

8. The driving control circuit according to claim 1, wherein the plurality of TMIC are configured to vary an output value of a separate option pin assigned in an integrated circuit when matching the end locations of the horizontal intervals of the data enable signals.

9. The driving control circuit according to claim 1, wherein, when the master TMIC supplies the gate output enable signal to a gate driver integrated circuit (IC), a register value, which is separately provided using an inter-integrated circuit or a serial peripheral interface, is varied in order to perform adjustment so as to indicate a rising edge of the gate output enable signal before the data latch enable signal having the highest frequency for each cycle is supplied.

10. The driving control circuit according to claim 1, wherein, when the master TMIC supplies the gate output enable signal to the gate driver integrated circuit (IC), a separated option pin is assigned to an integrated circuit and an output value of the option pin is varied in order to perform adjustment so as to indicate a rising edge of the gate output enable signal before the data latch enable signal having the highest frequency for each cycle is supplied.

* * * * *

UNITED STATES PATENT AND TRADEMARK OFFICE

CERTIFICATE OF CORRECTION

PATENT NO. : 8,698,857 B2
APPLICATION NO. : 13/335224
DATED : April 15, 2014
INVENTOR(S) : Young Gi Kim et al.

It is certified that error appears in the above-identified patent and that said Letters Patent is hereby corrected as shown below:

Title page, item [75] inventor name:
change "Ki" to --Gi--.

Signed and Sealed this
Second Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,698,857 B2
APPLICATION NO. : 13/335224
DATED : April 15, 2014
INVENTOR(S) : Kim et al.

It is certified that error appears in the above-identified patent and that said Letters Patent is hereby corrected as shown below:

Title Page,

Item [75], Inventors, "Gi" (as corrected to read in the Certificate of Correction issued September 2, 2014) is deleted and patent is returned to its original state with first inventor middle name in patent to read --Ki--.

Signed and Sealed this
Thirtieth Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,698,857 B2
APPLICATION NO. : 13/335224
DATED : April 15, 2014
INVENTOR(S) : Kim et al.

It is certified that error appears in the above-identified patent and that said Letters Patent is hereby corrected as shown below:

Title Page, Item (75) Inventor is corrected to read:
-- Young-Gi Kim, Daejeon-si (KR);
Hye-Lan Kim, Asan-si (KR);
Na-Ra Hong, Daejeon-si (KR);
Joon-Ho Na, Daejeon-si (KR) --.

Signed and Sealed this
Sixteenth Day of February, 2016

Michelle K. Lee

Michelle K. Lee
*Director of the United States Patent and Trademark Office*